US007900399B2

(12) United States Patent
Williams et al.

(10) Patent No.: US 7,900,399 B2
(45) Date of Patent: Mar. 8, 2011

(54) PORTABLE START GATE ASSEMBLY

(76) Inventors: Gary Williams, Astoria, IL (US); Phillip Layne, Rushville, IL (US)

( * ) Notice: Subject to any disclaimer, the term of this patent is extended or adjusted under 35 U.S.C. 154(b) by 519 days.

(21) Appl. No.: 11/717,992

(22) Filed: Mar. 14, 2007

(65) Prior Publication Data

US 2008/0222960 A1 Sep. 18, 2008

(51) Int. Cl.
*E01F 13/04* (2006.01)

(52) U.S. Cl. ..... 49/49; 49/29; 49/131; 404/9

(58) Field of Classification Search ..... 49/29, 30, 49/49, 131; 404/9
See application file for complete search history.

(56) References Cited

U.S. PATENT DOCUMENTS 2,559,796 A * 7/1951 Rath ..... 346/17
3,994,491 A * 11/1976 Mascotte et al. ..... 472/85
4,051,811 A * 10/1977 Smith ..... 119/422
4,134,230 A * 1/1979 Roy ..... 49/49
4,711,608 A * 12/1987 Ghusn ..... 404/6
4,875,797 A * 10/1989 Hartwig ..... 404/9
5,050,346 A * 9/1991 Eccleston ..... 49/280
7,477,133 B2 * 1/2009 Abdulkader ..... 340/323 R
2005/0069383 A1 * 3/2005 Gunderson ..... 404/6
2006/0029467 A1 * 2/2006 Johnson ..... 404/60
2007/0207868 A1 * 9/2007 Burry et al. ..... 472/85
2007/0248409 A1 * 10/2007 Barker et al. ..... 404/6

* cited by examiner

*Primary Examiner* — Gregory J. Strimbu
(74) *Attorney, Agent, or Firm* — Law Office of Robert M Patino

(57) ABSTRACT

A start gate assembly for use by a racer when racing on a ground surface is provided with a moveable start gate frame that is pivotally attached to a foundation platform and a moving mechanism for placing the moveable start gate frame in a ready position where the ready position is of sufficient height to obstruct forward movement of the racer. A control device is further provided that regulates the movement of the moveable start gate frame from the ready position to a go position and a start switch that activates the control device to initiate the moving mechanism.

17 Claims, 3 Drawing Sheets

PORTABLE START GATE ASSEMBLY

BACKGROUND OF THE INVENTION

The present invention relates to a start gate assembly for use by a racer when racing or practicing, and more particularly to such a start gate assembly used for motocross or motorbike racing vehicles that allow the racer himself to practice start times without the assistance of a second person.

Motocross racing has become an increasingly popular sport in the United States after World War II and is extremely popular in Europe. Motocross has evolved from relatively flat, off-road races to hilly, dirty races filled with obstacles to provide a challenging environment for the driver and a test for the machine that they ride. Supercross races eventual started springing up to bring racing in urban and suburban areas that brought the concept of these outdoor races inside where artificial hills and obstacles could be added on a race track in a sports stadium. Given the popular fan base and the corporate sponsorship that supports these types of races, a lot of money can be made for a successful racer.

As racers clearly have to be competent drivers and have a strong command over their machine's performance, one of the most critical components to a racer's success is their ability to get a good jump out of the start gate. Due to the difficultly of the terrain and the windiness of the tracks, it can be extremely difficult for other racers to overtake their leaders during a race. These facts, combined with the narrowness of some courses, further strengthen the need to be the leader right out of the start gate to greatly improve the racer's chance of winning the race.

Today's motocross and supercross racers must practice start times to help increase their odds of being the leader in competitive races. However, in order to train to help better their racing start times, a racer is limited to using readily available track equipment and start gates. Current start gate designs are manual in nature and require a second party to be available to set and open the start gates. The manual start gates are attached together so that multiple racers can start at the same time. Someone must set the gates to a ready position by hand, although some designs use a latch or pedal. The ready position is secured by a locking mechanism that is of a constant height to ensure consistent start gate heights by all racers. A pull string is then used to collapse the start gates so that the racers might proceed forward unimpeded. The pull string is operated by a second party that stands on one of the sides of the manual start gate, thus requiring the need of an additional person besides the racer.

Another issue not addressed by current manual start gates is that it is impractical for an operator to take these manual start gates with them for practice because they are too large and bulky for transport. There are no known start gates that exist for backyard or alternative site practicing. Furthermore, a racer practicing with the manual start gates does not have an indicator to prompt the racer to anticipate the manual start gate dropping.

The start gate assembly might also be further modified to accommodate multi-racer usage so that several start gate assemblies might be placed together in a linear manner and used as one for racing. Current start gates for motocross racing are permanently attached together and are not easily taken apart for single user operations. It would be convenient and beneficial to have an automated operation start gate assembly that can be used by one racer, yet capable of fitting other start gate assemblies for multi-racer events.

Therefore, it is desired to have a start gate assembly for practice that can be easily operated by the racer while on a motorbike or other type of racing vehicle. Furthermore, it is desired that this start gate assembly has safety features that protect the start gate assembly itself and the race. An indication device is also desired that communicates to the racer that the start gate assembly is about to move to a go position. Additionally, the start gate assembly is desired to be light and transportable so that the start gate assembly can be easily moved from one location to another. It is also desired that a start gate assembly might be adaptable for use with multiple start gate assemblies such that several racers might utilize the start gate assembly for racing purposes.

Thus, there is a need for a start gate assembly capable of being used and operated solely by a racer without the assistance of a second person. Racers need the ability to practice their starting times away from the track to perfect their start times, thereby, making it necessary to have a start gate assembly that can be transported in the back of a vehicle. Moreover, there is a need for such a start gate assembly to be safe for operation to minimize the risk of harm to the racer or the start gate assembly itself.

BRIEF SUMMARY OF THE INVENTION

The above-identified needs are addressed by the present start gate assembly for use by a racer when racing or practicing. One feature of the present invention is a moveable start gate frame that can be modified to resemble a barrier normally associated with racing start gates. The moveable start gate frame is pivotally attached to a foundation platform to erect itself to a ready position and allowed to fall to a go position. By giving the moveable start gate frame the ability to swing freely to a false start position when acted upon as a racer moves forward before the start gate assembly moves to a go position, injury to the racer and start gate assembly can be avoided. Therefore, the present invention is provided with an open ended lift lever to allow the moveable start gate assembly to freely swing to a false start position.

Another feature of the present invention is to provide a start switch that can be operated by a racer while he resides in or on his vehicle. The start switch is capable of sending an electrical signal to a control panel that in turn, directs a lift mechanism when to lift the start gate assembly to the ready position and when to move the start gate assembly to the go position. The control panel also activates an indicator to inform the racer when the start gate assembly is about to move to the go position. An additional feature of the present invention is that the start gate assembly is small and light enough to be easily transported by a minimal number of movers from one location to another location so that the start gate assembly can be used in various and multiple venues.

More specifically, a start gate assembly for use by a racer when racing on a ground surface is provided with a moveable start gate frame where the moveable start gate frame is pivotally attached to a foundation platform. A moving mechanism is additionally provided for placing the moveable start gate frame in a ready position so that forward movement of the racer is obstructed sufficiently for racing purposes. A control device is also provided that regulates the movement of the moveable start gate frame from the ready position to a go position relative to when a start switch is activated to initiate movement of the moving mechanism.

In another embodiment, a start gate assembly for use by a racer when racing on a ground surface is provided with a moveable start gate frame pivotally attached to a foundation platform wherein the foundation platform lies in a substantially planar relationship with the ground surface. A pneumatic lift device is employed for placing the moveable start gate frame in a ready position where the ready position is further defined as being of sufficient height to obstruct forward movement of the racer. The moveable start gate frame is placed at an acute angle relative to the ground surface when in the ready position such that the moveable start gate frame is moveable to a go position by gravity induced force. A control device is further provided to regulate the movement of the moveable start gate frame from the ready position to the go position.

In yet another embodiment, a start gate assembly for use by a racer when racing when racing on a ground surface is provided with a moveable start gate frame that is pivotally attached to a foundation platform. The start gate assembly is also provided with a pneumatic lift device for placing the moveable start gate frame in a ready position. A start switch activates a control device to initiate operation of the pneumatic lift device and further controls the activation of an at least one indicator light associated with the control device to communicate when, relative to triggering the start switch, that the moveable start gate frame will move to the go position.

DETAILED DESCRIPTION OF THE INVENTION

Figure 1:
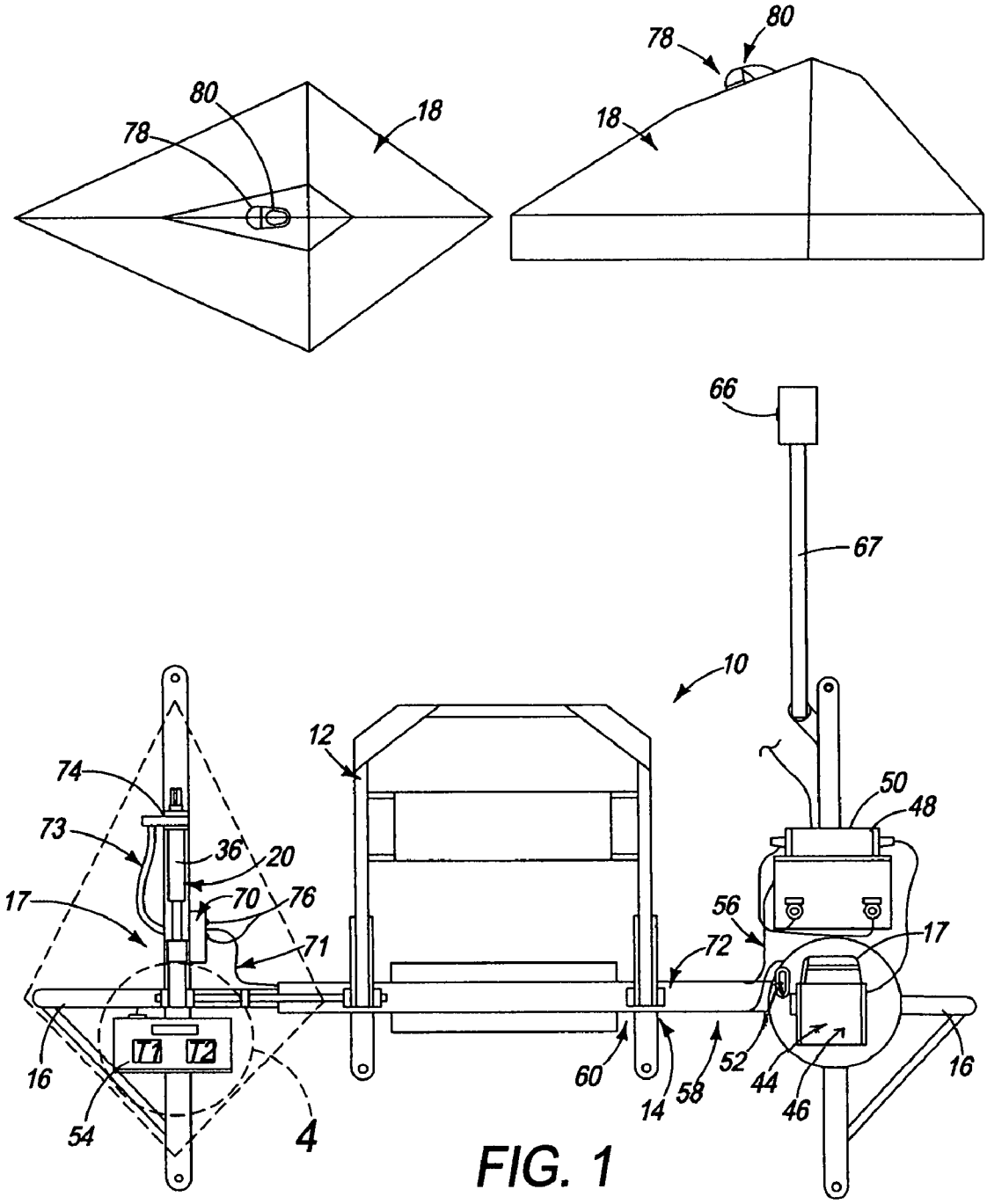
FIG. 1 is a top plan view of a start gate assembly that has a start switch, a pair of assembly covers removed from the ends to illustrate their shape, and at least one indicator. The number 4 points to a broken circle that is further represented in a close up view shown in detail in FIG. 4.

Referring now to FIG. 1, start gate assembly for use by a racer when racing on a ground surface is generally designated 10. A moveable start gate frame 12 is provided that is preferably of an upside down "U" shape which is standard design for motocross racing start gates and is pivotally attached to a foundation platform 14. The moveable start gate frame 12 is also sufficiently thin so as to limit its impedance of a racer when driven over by a motorbike or other racing vehicle, yet made of durable material such as steel to withstand deformation or damage when weight or impact forces are applied. The foundation platform 14 is sufficiently wide to accommodate the width of the moveable start gate frame 12. In the preferred embodiment, the foundation platform is provided with a pair of equipment support ends 16 that support a set of driving parts 17 of the start gate assembly 10 which are used to run the moveable start gate frame 12. In the most preferred embodiment, the pair of equipment support ends 16 also doubles as a means of hingedly attaching a start cover 18 to protect the set of driving parts 17 from damage and to provide an quick means of accessing the set of driving parts for maintenance and repair. Furthermore, the start covers 18 in conjunction with the moveable start gate frame 12 provide an imaginary start box for racers to position themselves when starting.

Figure 2A:
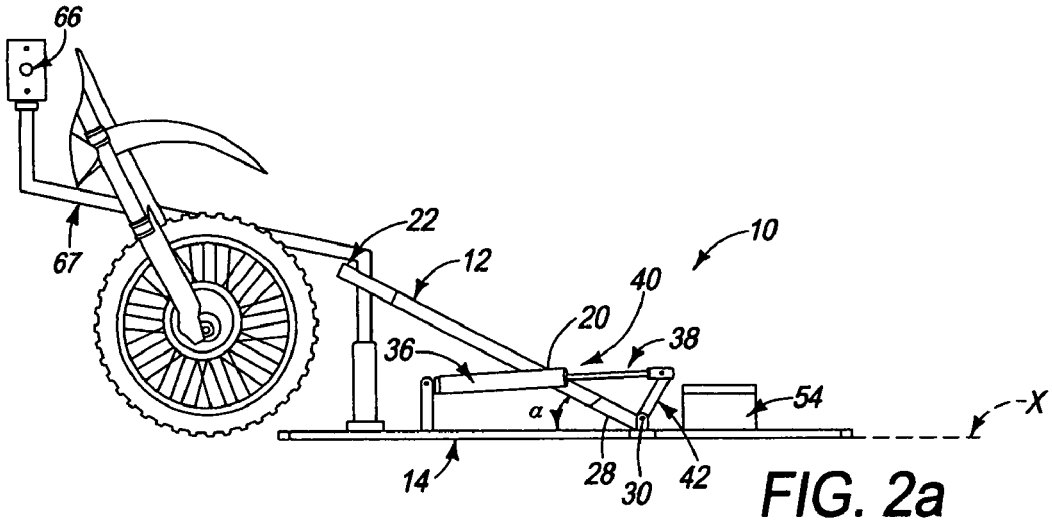
FIG. 2*a* is a side perspective view of the start gate assembly in a ready position in relation to a motorbike and start switch.
Figure 2B:
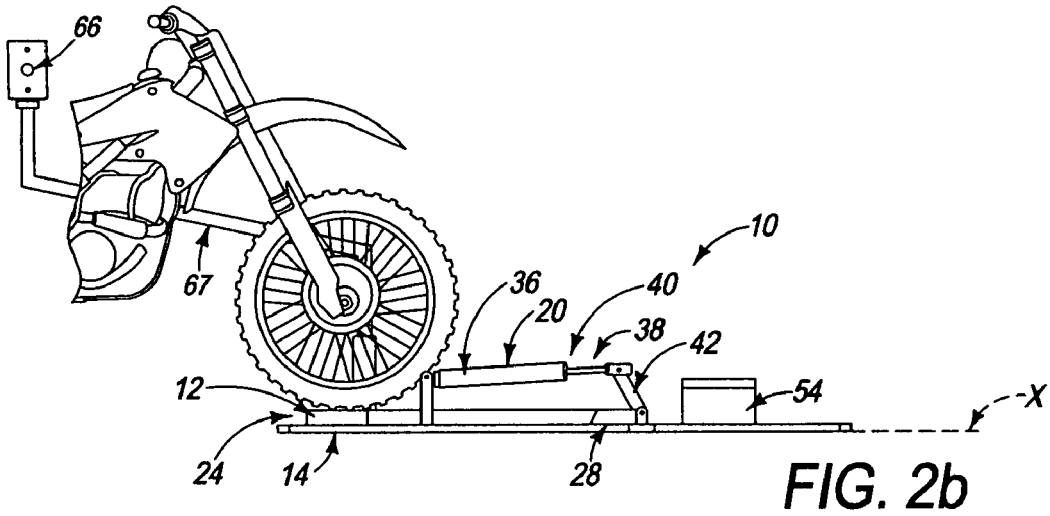
FIG. 2*b* is a side perspective view of the start gate assembly in a go position.
Figure 2C:
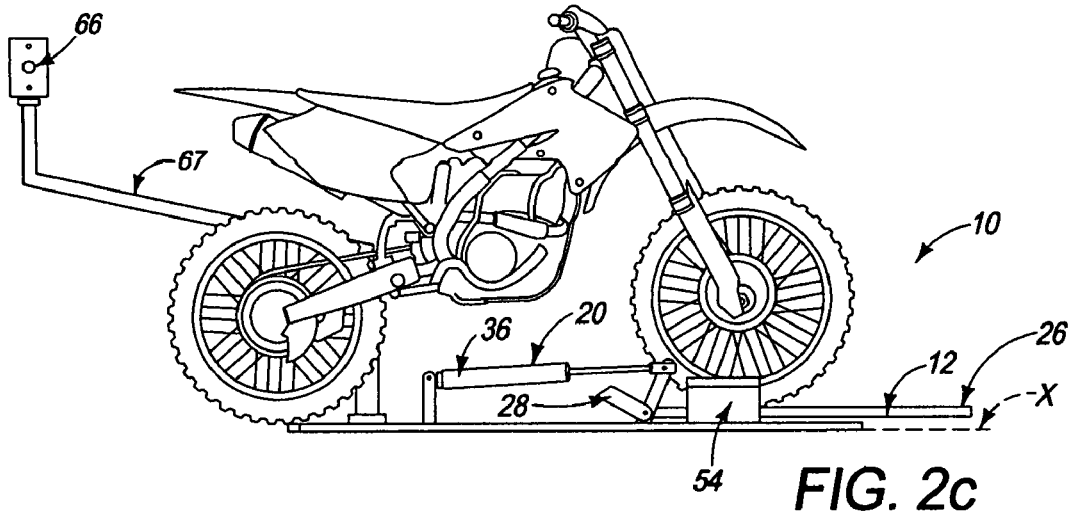
FIG. 2*c* is a side perspective view of the start gate assembly in a false start position where the motorbike moves forward before the start gate assembly drops to the go position.

Now referring to FIGS. 2*a*, 2*b*, and 2*c*, the moveable start gate frame 12 is moveable from a substantially 0 degree angle relative to a support plane X of the foundation platform 14 to a substantially 180 degree angle relative to the support plane X of the foundation platform 14. A moving mechanism 20 is provided for placing the moveable start gate frame in a ready position 22 (as shown in FIG. 2*a*) wherein the ready position 22 is of sufficient height to obstruct forward movement of the racer. The ready position 22 is further defined as an acute angle $\alpha$ such that the moveable start gate frame 12 is moveable to a go position 24 (as shown in FIG. 2*b*) by gravity induced force. The go position 24 is further defined as a substantially 0 degree angle relative to the support plane X. The moveable start gate frame 12 is supported in the ready position 22 in a manner such that the moveable start gate frame 12 is freely moveable to a false start position 26 (as shown in FIG. 2*c*) when the moveable start gate frame 12 is engaged before the moveable start gate frame 12 is moved to the go position 24. The false start position 26 may also be further defined as a substantially 180 degree angle relative to the support plane X.

Figure 3:
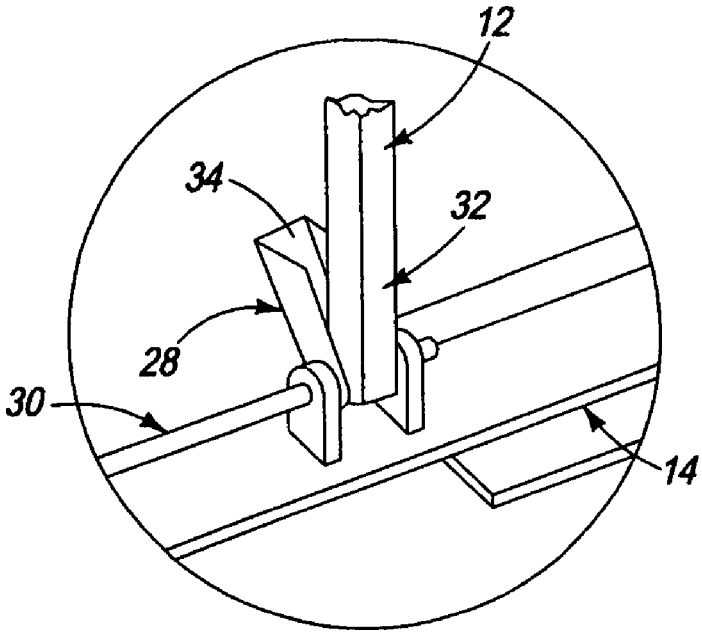
FIG. 3 is a front perspective view of the pivotal attachment point of a moveable start gate frame and an open ended lift lever.

Now referring to FIG. 3, in the preferred embodiment, a lift lever 28 is securely fastened to a rotation rod 30 to maneuver the moveable start gate frame 12 from the go position 24 to the ready position 22. The lift lever 28 is extended behind a pivotally attached leg 32 of the moveable start gate frame 12 to lift the moveable start gate frame 12 rotationally. A receiving side 34 of the lift lever 28 is left open to allow the moveable start gate frame 12 to freely move forward rotationally to the false start position 26 in the event that the racer where to advance his vehicle forward before the moveable start gate frame 12 were to move to the go position 24. In the most preferred embodiment, only one lift lever 28 is utilized, but it is contemplated that multiple lift levers 28 could be used to accommodate each attached leg 32 of the moveable start gate frame 12.

Now referring to FIGS. 1, 2*a* and 2*b*, the moving mechanism 20 for placing the moveable start gate frame 12 in the ready position 22 is preferably provided by a pneumatic lift device 36. However, it is contemplated that other lift devices may be employed such as a hydraulic piston, mechanical gears, or other device that may be automated. The pneumatic lift device 36 located underneath one of the start covers 18 and is provided with a pneumatic arm 38 set to a lift length 40 such that the moveable start gate frame 12 is consistently placed in the ready position 22. The lift length 40 is further defined as the difference of the length of the pneumatic arm 38 when residing in the ready position 22 and the go position 24. The pneumatic arm 38 is affixed to the rotation rod 30 by a driving lever 42 that rotates the rotation rod 30 when the pneumatic arm 38 is extended by the lift length 40, thereby raising the moveable start gate frame 12 to the ready position 22.

Now referring to FIG. 1, the pneumatic lift device 36 is powered by an air supply source 44 that delivers sufficient air pressure to move the pneumatic arm 38 to the lift length 40. In the most preferred embodiment, the air supply source 44 is an air compressor 46; however, pressurized air tanks and like air delivery systems may also be used. The pneumatic lift device 36 is fed air by the air compressor 46 which is positioned approximate to the pneumatic lift device 36 and is capable of delivering enough force from air pressure to raise the weight of the moveable start gate frame 12 from the go position 24 to the ready position 22.

The air compressor 46 is powered by a power supply source 48. Preferably, the power supply source 48 is a battery 50 for ease of mobility and the reduction of the need to find a fixed power supply source. The battery 50 employed in the preferred embodiment is a 12 volt battery that is connected electrically with the air compressor 46. The air compressor 46 is fitted with a mounted compressor air regulator 52 that maintains the air pressure generated by the air compressor 46 between approximately 110 psi and 85 psi. When the air pressure falls below 85 psi as read by the mounted compressor air regulator 52, the air compressor 46 is reactivated automatically to compress more air until the air pressure reaches approximately 110 psi, at which point the air compressor 46 switches off.

Figure 4:
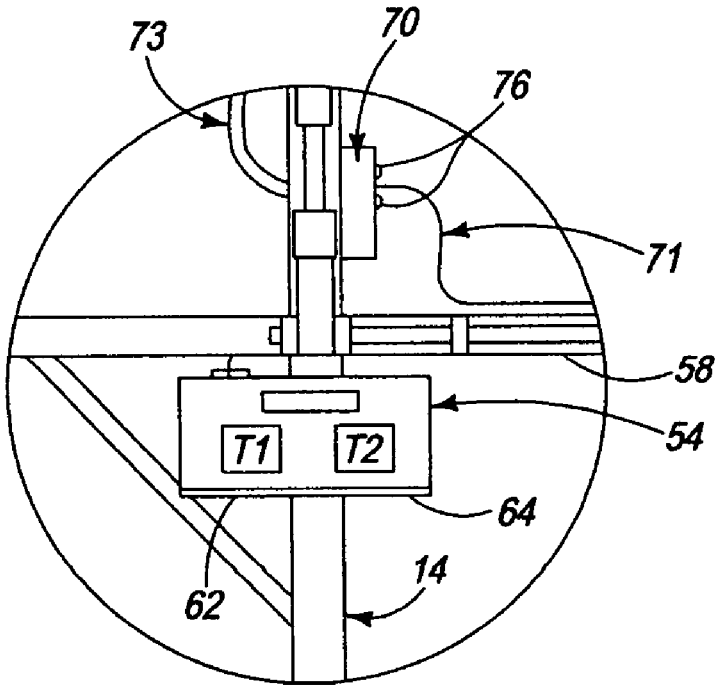
FIG. 4 is a top plan view of a control device that consists of two timers activated by the start switch (shown in FIG. 1).

Now referring to FIGS. 1 and 4, the power supply source 48 also powers a control device 54 that regulates the movement of the moveable start gate frame 12 from the ready position 22 to the go position 24. In the preferred embodiment, an electrical control feed wire 56 is fed from the power supply source 48 through a wire control tube 58 affixed to a lower side 60 of the foundation platform 14 until it is fastened electrically to the control device 54. The control device 54 houses a pair of timers indicated by a T1 and T2, an air release timer 62 and an indicator timer 64.

A start switch 66 is provided that activates the control device 54 to initiate the moving mechanism 20. In the preferred embodiment, the start switch 66 is removeably and pivotally connected to the foundation platform 14 by a connection arm 67. In this manner, the start switch 66 can swivel to a comfortable position close to the racer for easy accessibility while he is on the vehicle. However, it is appreciated that a remote start switch might also be used to activate the control device 54 for portability ease. The start switch 66 using the pivotally attached design uses the electrical control feed wire 56 to control the electrical signal that is given to the control device 54.

The operation of a solenoid air release valve 70 is directed by the control device 54. An air tube 71 transports air from the air compressor 46 to the solenoid air release valve 70. The air tube 71 is preferably fed though the foundation platform 14 in a similar manner as the electrical control feed wire 56, but on an electrical control wire opposing side 72. The triggering of the start switch 66 initiates the air release timer 62 that simultaneously sends a signal to the solenoid air release valve 70 to allow air from the air compressor 46 to be fed into the pneumatic lift device 36 via a pneumatic tube feed line 73. The solenoid air release valve 70 is placed between the pneumatic tube feed line 73 and the air tube 71 which lead up to the pneumatic lift device 36 to regulate air fed into and out of the pneumatic lift device 36.

The air fed into the pneumatic lift device 36 creates sufficient air pressure to drive the pneumatic arm 38 the lift length 40 while bearing the weight of the moveable start gate frame 12 to place the moveable start gate frame 12 in the ready position 22. A pneumatic air regulator 74 is preferably provided on the end of the pneumatic tube feed line 73 to prevent extensive air pressure from building up that might otherwise damage the pneumatic lift device 36. The air release timer 62 is preset to a predetermined amount of time that the racer or user believes would be an adequate wait time from triggering the start switch 66 and starting a race or practice run. When the predetermined amount of time expires, air is then released out the solenoid air release valve 70 through a pair of exit baffles 76. The pair of exit baffles 76 allow the pressure to be released rapidly from within the pneumatic lift device 36 and the pneumatic tube feed line 73 without causing much noise. When the air pressure is released from the pneumatic lift device 36, the moveable start gate frame 12 falls to the go position 24 by gravity induced force.

The start gate assembly 10 may optionally be provided with an at least one indicator 78 associated with the control device 54 to communicate to the racer when the moveable start gate frame 12 will move. In the most preferred embodiment, the at least one indicator 78 is a light 80 that visually signals a ready time when the moveable start gate frame 12 is about to drop to the go position 24. Preferably, two separate lights 80 are used, one on top of each opposing start cover 18. The at least one indicator 78 may also be a sound or other sensory affect that signals to the racer that the moveable start gate frame 12 is about to drop to the go position 24.

The at least one indicator 78 is operated in a similar fashion as the pneumatic lift device 36 when commanded by the control device 54. When the racer or other user triggers the start switch 66, the indicator timer 64 is initiated. The indicator timer 64 is preferably preset to a specified time purposely set to expire just a couple seconds before the air release timer 64. In doing so, the indicator timer 64 sends an electrical signal to the at least one indicator 78 to set off the at least one indicator 78. In the preferred embodiment, a pair of lights 80 light up to signal to the driver that the moveable start gate frame 12 is about to drop to the go position 24.

While a particular embodiment of the present start gate assembly has been described herein, it will be appreciated by those skilled in the art that changes and modifications may be made thereto without departing from the invention in its broader aspects and as set forth in the following claims. It is also contemplated that the described utility design herein may be modified to accommodate multiple start gate assemblies aligned side by side by an extension of the rotation rod 30 to support additional lift levers 28 to achieve substantially the same function of the single state gate assembly 10.

We claim:

1. A start gate assembly for use by a racer when racing on a ground surface, comprising:

a moveable start gate frame, said moveable start gate frame is pivotally attached to a rotation rod located on a foundation platform and said moveable start gate frame is supported and partially received by an open faced lift lever when said moveable start gate frame is in a ready position, said open faced lift lever is fastened to said rotation rod for rotation therewith, wherein said moveable start gate frame is rotateably moveable about said rotation rod independent of said open faced lift lever in a rotation direction from said ready position for deterring the racer from racing to a false start position which indicates that the racer made a false start;

an actuator that selectively drives said open faced lift lever to move said moveable start gate frame from a go position which allows the racer to race to said ready position; and a control device that releases said open faced lift lever which allows said moveable start gate frame to fall from said ready position to said go position under the influence of gravity.

2. The start gate assembly of claim 1, wherein said moveable start gate frame in said go position is moveable from a substantially 0 degree angle relative to a support plane of said foundation platform to a substantially 180 degree angle relative to said support plane of said foundation platform when said moveable start gate frame is in said false start position.

3. The start gate assembly of claim 1, wherein said moveable start gate frame is supported in said ready position by said open faced lift lever such that said moveable start gate frame is freely moveable to said false start position when said moveable start gate frame is moved in said rotation direction before said moveable start gate frame is released to fall to said go position.

4. The start gate assembly of claim 1, wherein said actuator is a placing said moveable start gate frame in said ready position is a pneumatic device.

5. The start gate assembly of claim 4, wherein said pneumatic device is provided with a pneumatic arm.

6. The start gate assembly of claim 5, wherein said pneumatic device is powered by an air supply source that delivers air pressure to move said pneumatic arm.

7. The start gate assembly of claim 6, wherein said air supply source is an air compressor.

8. The start gate assembly of claim 7, wherein said air compressor is powered by a power supply source.

9. The start gate assembly of claim 8, wherein said power supply source is a battery.

10. The start gate assembly of claim 1, the start gate assembly further comprising at least one indicator associated with said control device to indicate when said moveable start gate frame allowed to move to said go position.

11. The start gate assembly of claim 10, wherein said at least one indicator is a light.

12. A start gate assembly for use by a racer when racing on a ground surface, comprising:

a moveable start gate frame, said moveable start gate frame is pivotally attached to a rotation rod located on a foundation platform and said moveable start gate frame is supported and partially received by an open faced lift lever when said moveable start gate frame is in a ready position, said open faced lift lever is fastened to said rotation rod for rotation therewith, wherein said moveable start gate frame is rotateably moveable about said rotation rod independent of said open faced lift lever in a first rotation direction from said ready position to a false start position which indicates the racer made a false start a pneumatic lift device that selectively drives said open faced lift lever which moves said moveable start gate frame in said first rotation direction from a go position which allows the racer to race to said ready position, wherein when in said ready position said moveable start gate frame obstructs forward movement of the racer and is placed at an acute angle relative to a plane defined by said foundation platform; and a control device that releases said open faced lift lever which allows said moveable start gate frame to fall from said ready position to said go position under the influence of gravity in a second rotation direction opposite said first rotation direction.

13. The start gate assembly of claim 12, wherein said pneumatic lift device is fed air by an air compressor which is capable of delivering air pressure to raise said moveable start gate frame from said go position to said ready position.

14. The start gate assembly of claim 13, wherein a solenoid air release valve is placed on an pneumatic tube feed line for said pneumatic lift device to regulate the air in said pneumatic lift device.

15. The start gate assembly of claim 14, wherein operation of said solenoid air release valve is directed by said control device.

16. The start gate assembly of claim 13, wherein a pneumatic air regulator is placed on said pneumatic lift device to regulate the air pressure in said pneumatic lift device.

17. The start gate assembly of claim 12, further comprising an indicator for indicating when said moveable start gate frame will be released to fall from said ready position to said go position, said indicator is activated by an indicator timer located within said control device initiated when a start switch is triggered.

* * * * *